US010808404B2

(12) United States Patent
Castellucci

(10) Patent No.: US 10,808,404 B2
(45) Date of Patent: Oct. 20, 2020

(54) PROFILES

(71) Applicant: HADLEY INDUSTRIES OVERSEAS HOLDINGS LTD., Smethwick (GB)

(72) Inventor: Michael Castellucci, Birmingham (GB)

(73) Assignee: Hadley Industries Overseas Holdings Ltd., Smethwick (GB)

( * ) Notice: Subject to any disclaimer, the term of this patent is extended or adjusted under 35 U.S.C. 154(b) by 566 days.

(21) Appl. No.: 15/508,669

(22) PCT Filed: Sep. 7, 2015

(86) PCT No.: PCT/GB2015/052580

§ 371 (c)(1),
(2) Date: Mar. 3, 2017

(87) PCT Pub. No.: WO2016/034906

PCT Pub. Date: Mar. 10, 2016

(65) Prior Publication Data

US 2017/0254081 A1 Sep. 7, 2017

(30) Foreign Application Priority Data

Sep. 5, 2014 (GB) ..... 1415747.3
Feb. 3, 2015 (GB) ..... 1501792.4

(51) Int. Cl.
*B21D 5/08* (2006.01)
*B21D 13/04* (2006.01)
(Continued)

(52) U.S. Cl.
CPC ..... *E04C 3/07* (2013.01); *B21D 5/08* (2013.01); *B21D 13/04* (2013.01); *B21H 8/005* (2013.01);
(Continued)

(58) Field of Classification Search
CPC ..... E04C 3/07; E04C 2003/0473; E04C 2003/0434; E04C 2003/0421; E04B 2/60;
(Continued)

(56) References Cited

U.S. PATENT DOCUMENTS 2,831,428 A 4/1958 Dahlberg
3,273,976 A 9/1966 Wogerbauer
(Continued)

FOREIGN PATENT DOCUMENTS

CA 2568111 A1 5/2008
CN 1209181 A 2/1999
(Continued)

OTHER PUBLICATIONS

English language abstract for JPH05161921 (A) (Jun. 29, 1993).
(Continued)

*Primary Examiner* — Daniel J. Schleis
*Assistant Examiner* — Kevin C T Li
(74) *Attorney, Agent, or Firm* — Caesar Rivise, PC

(57) ABSTRACT

An elongate profile (1) having a first portion (2) and a second portion (3), the first and second portions (2, 3) being joined together at a first joining portion (JP1), the first and second portions (2, 3) being non collinear, the joining portion (JP1) comprising an array of raised or rebated formations (10*a*), each formation extending across the joining portion (JP1) in a direction which is non-parallel to the principal axis of the profile and flat lands being provided between successive formations in an array (10A) and the pitch (P) between successive formations in an array being from 2 to 20 times, for example from 5 to 15 times, the thickness (G) of the flatlands.

12 Claims, 10 Drawing Sheets

(51) Int. Cl.

| | |
|---|---|
| ***E04B 2/78*** | (2006.01) |
| ***E04C 3/07*** | (2006.01) |
| ***E04C 3/04*** | (2006.01) |
| ***B21H 8/00*** | (2006.01) |
| ***E04B 2/74*** | (2006.01) |
| ***E04B 2/60*** | (2006.01) |

(52) U.S. Cl.
CPC ..... *E04B 2/60* (2013.01); *E04B 2/7457* (2013.01); *E04B 2/789* (2013.01); *E04C 2003/0421* (2013.01); *E04C 2003/0434* (2013.01); *E04C 2003/0473* (2013.01)

(58) Field of Classification Search
CPC ..... E04B 2/789; E04B 2/7457; B21D 13/04; B21D 5/08; B21H 8/005
See application file for complete search history.

(56) References Cited

U.S. PATENT DOCUMENTS

| | | | | |
|---|---|---|---|---|
| 4,580,388 | A | 4/1986 | Maisch | |
| 4,793,113 | A | 12/1988 | Bodnar | |
| 5,941,109 | A | 8/1999 | Johnson et al. | |
| 6,381,916 | B1 | 5/2002 | Maisch et al. | |
| 2008/0110126 | A1* | 5/2008 | Howchin | E04C 3/07 52/630 |
| 2009/0188399 | A1 | 7/2009 | Uratani | |
| 2010/0229501 | A1* | 9/2010 | Bodnar | E04C 3/09 52/846 |
| 2011/0067328 | A1* | 3/2011 | Naccarato | E04F 11/00 52/182 |
| 2011/0296897 | A1 | 12/2011 | Knauf | |

FOREIGN PATENT DOCUMENTS

| | | | | |
|---|---|---|---|---|
| CN | 101151426 | A | 3/2008 | |
| CN | 104514308 | A | 4/2015 | |
| DE | 2128588 | A1 | 1/1972 | |
| DE | 29808344 | U1 | 8/1998 | |
| DE | 20022426 | U1 | 8/2001 | |
| EP | 0017647 | A1 * | 10/1980 | E04C 2/32 |
| EP | 0017647 | A1 | 10/1980 | |
| EP | 0017647 | B1 * | 2/1982 | E04C 2/32 |
| EP | 0372980 | A1 | 6/1990 | |
| EP | 1634660 | A1 | 3/2006 | |
| EP | 1950359 | A1 | 7/2008 | |
| EP | 2116658 | A2 | 11/2009 | |
| FI | 8481 | U | 3/2009 | |
| GB | 2276350 | A | 9/1994 | |
| GB | 2279596 | A | 1/1995 | |
| JP | H05161921 | A | 6/1993 | |
| JP | H07115088 | B2 | 12/1995 | |
| JP | H08218493 | A | 8/1996 | |
| RU | 2162414 | C2 | 1/2001 | |
| WO | 9321405 | A1 | 10/1993 | |
| WO | 9508409 | A1 | 3/1995 | |
| WO | 9723694 | A1 | 7/1997 | |
| WO | 9734059 | A1 | 9/1997 | |
| WO | 2012072959 | A1 | 6/2012 | |

OTHER PUBLICATIONS

English language abstract for DE 20022426 (Aug. 9, 2001).
Examination Report from related GB1715280.2 dated Oct. 10, 2017.
Examination Report from related GB1720463.7 dated Jan. 30, 2018.
Examination Report from related NZ 730117 dated Sep. 18, 2017.
Examination Report from related NZ 730117 dated May 16, 2018.
English language abstract for EP 0017647 A1 (1980).
English language abstract for JP H05161921 A (1993).
English language abstract for JP H08218493 A (1996).
International Search Report from corresponding PCT/GB2015/052580 dated Dec. 14, 2015.
Search Report from related GB 1415747.3 dated May 22, 2015.
Search Report from related GB 1415747.3 dated Feb. 12, 2015.
English Language Abstract for RU 2162414 C2.
Russian Search Report for Application No. 2019126804 dated Jan. 16, 2020.

* cited by examiner

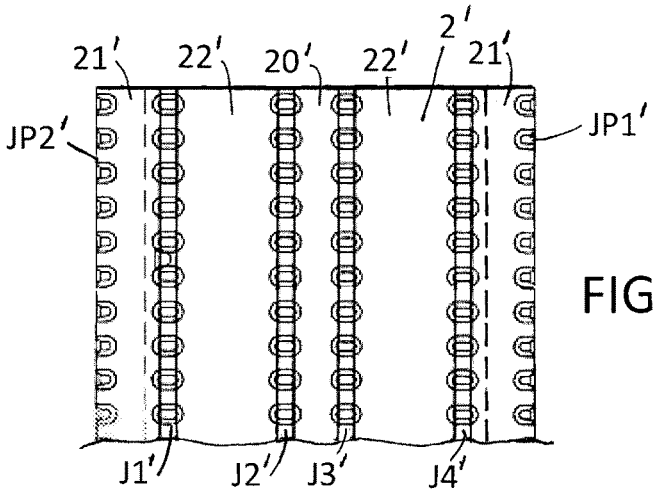
FIG. 2C
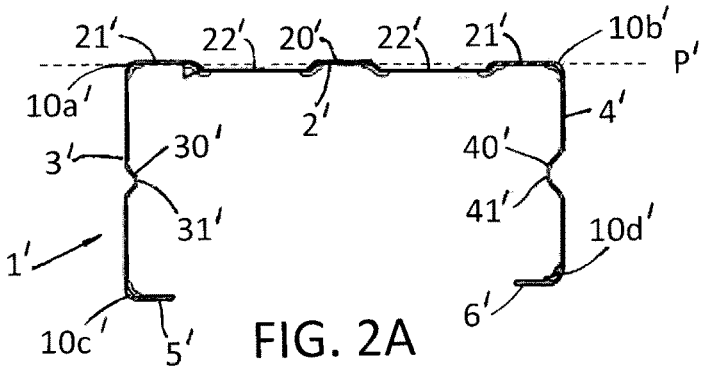
FIG. 2A
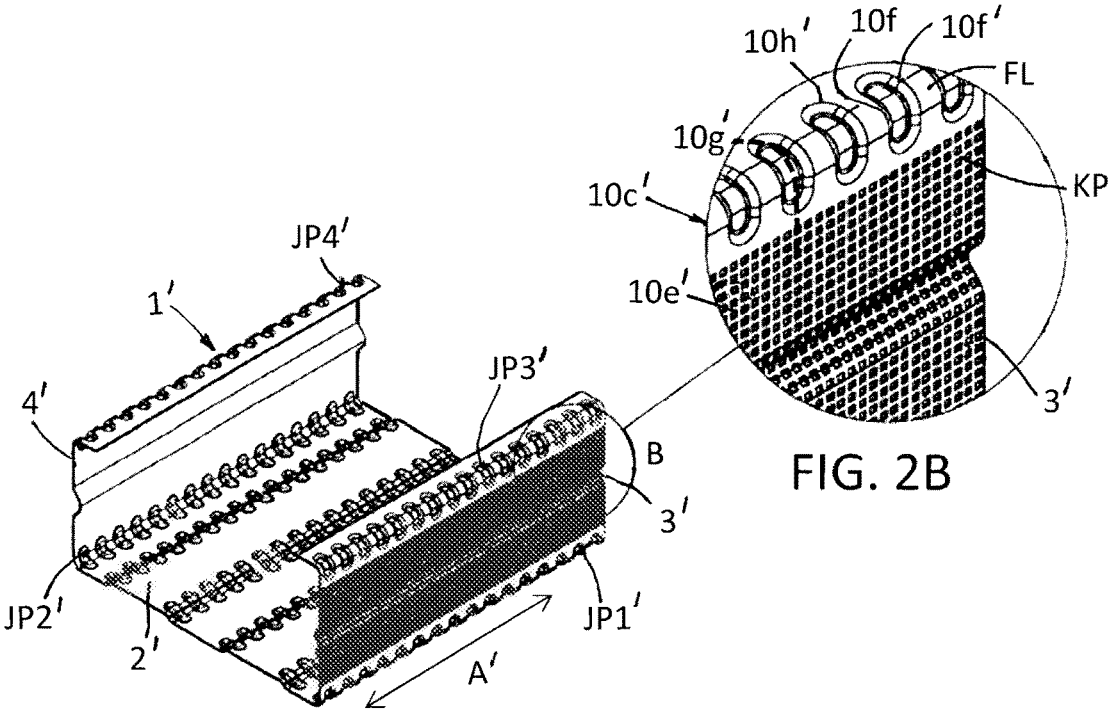
FIG. 2B
FIG. 2

PROFILES

CROSS-REFERENCE TO RELATED APPLICATIONS

This application is the U.S. National Phase Application of PCT/GB2015/052580, filed Sep. 7, 2015, which claims priority from GB 1415747.3, filed Sep. 5, 2014, and GB 1501792.4, filed Feb. 3, 2015, the contents of which applications are incorporated herein by reference in their entireties for all purposes.

This invention relates to profiles, specifically but not exclusively, to metal profiles useful for forming a framework.

It is known in the building industry to make walls from plasterboard and suspended ceilings from ceiling tiles. In the former, plasterboard sections are secured on either side of a supporting structure or framework to make a stud wall. In the latter, a supporting structure in the form of frame members form a grid and the ceiling tiles are located such that their peripheries are supported by the grid. Both of these may be termed 'dry constructions'.

The supporting structure for dry constructions may be formed from one or more metal profiles or sections, those typically being shaped lengths of metal formed by bending sheet material to the desired shape.

Typically, to make a wall for a dry construction a length of track section is secured to both the floor and the ceiling and plural vertical stud members (lengths of stud section) are located therebetween with one end of each stud member located within the floor track and the other end within the ceiling track. Horizontal members may be provided between vertical stud members.

A track profile or section is typically called a U-section with an elongate base and a pair of parallel sides extending away from either side of the base. A stud member is typically called a C-section and has a base portion, a pair of parallel side portions extending from either side of the base, each side portion having at its distal portion an in-turned ledge or flange which overlies the base. The in-turned flanges act to rigidify the structure. C-sections may be placed in facing and abutting relations to form a rectangular 'box section'. With C-sections made from plain sheet steel it is known that the two parts (C-sections) of a so-formed box section are able to slip longitudinally with respect to one another.

The plasterboard sections are secured to the stud members by screws or other securing means driven through the board and into a facing portion of a stud member. It is usual to use a stud member to support the terminal edges of adjacent, preferably abutting, plasterboard sections. Thus, an edge of a first plasterboard section typically overlies a portion, say first half, of the facing wall portion of a stud member and an edge of a second plasterboard section overlies a further, e.g. second half, portion of the facing wall portion of the stud member. In this way, with the edges of the plasterboard sections in close proximity, and preferably abutting, a stud wall is formed. The or any gap between adjacent plasterboard sections may be filled by plaster or other jointing compounds and/or the whole construction may be plaster skimmed and/or otherwise surface-treated (painted, wall papered etc.) to provide a usable and/or desired surface finish.

If the stud member flexes during, or subsequent to, the securing of the first plaster board section thereto or during the securing of the second plasterboard section thereto it is possible for a 'step' to develop between the outermost faces of the first and second plaster board sections. This is known as 'board stepping'. Board stepping leads to an unsightly finish and, in some cases, may mean that the stud wall has to be at least partially reconstructed or replaced.

Ceiling grids are often made from lengths of metal formed into T sections. The grid is typically formed from parallel lengths of T sections. The gap between succeeding parallel lengths is spanned by plural relative short lengths of T sections extending orthogonally to the parallel lengths. The T sections are typically provided in inverted form with a base portion comprising a pair of feet with a centrally disposed upstanding leg portion. Both parallel and relatively short lengths may be suspended from the ceiling by hangers or, alternatively, only the parallel lengths (or the parallel lengths and some of the orthogonal lengths) may be suspended by hangers. In this way a grid pattern is formed and ceiling tiles may be located in the spaces of the grid with their peripheries supported by the feet of the T sections. Clearly, the track section has to be able to hold the weight of the ceiling tiles in use, preferably without flexing.

Accordingly, it is important that profiles and sections are strong enough so that they can support the required loads in use and sufficiently stiff so as to be able to withstand deflecting forces.

A process for manufacturing profiles and sections, for example track sections, stud members and ceiling grid members, is known as cold rolling. In the cold rolling process sheet metal, usually supplied from a coil, is passed between a series of rollers until the flat sheet metal has been formed into the desired shape, known as a profile or section.

It is also known to use the process of cold rolling to work harden a sheet material, and, for example, to make the so-worked sheet stiffer than the nascent sheet material. One such process is disclosed in our patent EP0891234. In this process, sheet material is passed between a pair of matched male rollers each having rows and columns of teeth, the teeth of one roller locating in the gaps between the teeth on the other roller thereby to impart a particular array of projections and depressions on the sheet material. Because the sheet material has been cold rolled and work hardened it is stronger and/or stiffer than the starting material. Because the material is stronger and/or stiffer it is possible to use thinner starting sheet material and still obtain the same physical performance. Accordingly, this can lead to weight savings and/or strength improvements for a particular profile or section. Our further patent EP2091674 sets out a further method of work hardening sheet material which leads to further improvements. As well as fabricating sections or profiles for dry constructions, it is also possible to form thicker, structural sections from sheet material with a gauge of from, say, 1.2 mm or 1.5 mm to 3.0 mm.

It is an object of the current invention to provide a new profile, for example a profile which removes or at least reduces problems associated with prior art profiles and/or a profile which has improved properties.

A first aspect of the invention provides a profile having a first portion and a second portion, and being joined together at a first joining portion, the first and second portions being non collinear or non coplanar, the joining portion comprising an array of formations, e.g. embossed projections.

The projections may extend above or below the plane of the joining portion, i.e. the projections may be raised or rebated with respect to the joining portion. There is preferably a flat land between succeeding, adjacent, formations or projections.

Preferably the profile has a third portion. The third portion may be joined to the second portion at a second joining portion. Preferably the second and third portions are non collinear or non coplanar. The second joining portion may comprise an array of formations or embossed projections.

Preferably, one or both of the first and second portions has a longitudinal strengthening rib. If present the third portion may comprise a longitudinal strengthening rib.

Preferably the first and second portions extend substantially orthogonally. If present, the or a third portion may extend substantially orthogonally to the first portion.

A further aspect of the invention provides an elongate profile having a first portion and a second portion, the first and second portions being joined together at a first joining portion, the first and second portions being non collinear or non coplanar, the joining portion comprising an array of raised or rebated formations, each formation extending across the joining portion in a direction which is non-parallel to the principal axis of the profile and flat lands being provided between successive formations in an array.

A further aspect of the invention provides an elongate profile having a first portion and a second portion, the first and second portions being joined together at a first joining portion, the first and second portions being non collinear or non coplanar, the joining portion comprising an array of raised or rebated formations, each formation extending across the joining portion in a direction which is non-parallel to the principal axis of the profile and flat lands being provided between successive formations in an array and the pitch (P) between successive formations in an array being from 2 to 20 times, for example from 5 to 15 times, the thickness (G) of the flat land. The thickness (G) of the flat land being identical or at least substantially identical to the gauge (G) of the sheet material from which the profile is formed.

Another aspect of the invention provides an elongate profile having a first portion and a second portion and a first joining portion, the first and second portions being joined together at the first joining portion, the first and second portions being non co-linear or non coplanar, the joining portion comprising an array of embossed projections extending in the direction of the profile, the projections having a pitch P of from 2 to 20 times, for example from 5 to 15 times, the base gauge G of the sheet from which the profile is fabricated.

A yet further aspect of the invention provides an elongate profile having a first portion and a second portion and a first joining portion, the first and second portions being joined together at the first joining portion, the first and second portions being non co-linear or non coplanar, the joining portion comprising an array of embossed projections extending in the direction of the profile, each embossed projection extending outwardly or inwardly of the profile, preferably outwardly.

One or more of the formations or projections in an array or the arrays may be elongate. Preferably one or more of the formations or projections has a principal axis which is inclined, for example substantially orthogonal to, the principal axis of the profile.

The formations or projections may be rectangular, for example rectangular with rounded or curved ends. The formations or projections may have dimensions 7×2.5×1 (L×W×F).

In a preferred embodiment the profile is a U or C member. Alternatively it may be a Z, W, T, I or other sectional shape for example a section having a rectangular, trapezoidal, rhombohedral or triangular cross section.

Preferably the profile has a substantially flat elongate first, e.g. base, portion and elongate, e.g. second and third, wall, portions upstanding from either side of the first portion, each base portion to wall portion join being defined by a joining portion, an array of formations or embossed projections being distributed along each joining portion.

The array or one or more of the arrays may be regular or irregular. The pitch P between formations or projections in the array, or in one or more of the arrays, may be regular or irregular.

In preferred embodiments, we have determined that improved performance of a profile can be surprisingly achieved when the formation or projection has a form depth F of between greater than 1 and 4 times the base gauge, for example 1.5 and 4 times the base gauge G of the material, preferably between 1.6 and 3.5 times the base gauge G and most preferably from 1.8 to 3 times the base gauge G. That is, if the material has a base gauge G (i.e. the thickness of the sheet material before processing) of 0.6 mm the maximum distance (e.g. height or depth) of the projection from the obverse face of the profile will be from 0.9 to 2.4 mm, preferably from 1.05 to 2.1 mm, and most preferably from 1.08 to 1.8 mm.

At this form depth F, we have surprisingly found that the degree of thinning of the material caused by the or a embossing process and the improved strength/stiffness is balanced to produce a profile with improved performance.

Additionally or alternatively, the pitch P of the formations or projections may be altered to obtain improved performance. In some embodiments the pitch P in an array is preferably from 5 to 15 times the base gauge G of the material. Preferably the pitch P is from 6 to 14 times the base gauge G, and most preferably from 8 to 12 times the base gauge G. Therefore, if the base gauge G of the material is 0.6 mm the pitch P of formations or projections along an array may be from 3 to 9 mm, for example from 3.6 to 8.4 mm, preferably from 4.8 to 7.2 mm. We have surprisingly found that this range provides the so-formed profile with improved performance.

The width W of a formation or projection (which is measured in a direction parallel to the principal or longitudinal axis of the profile) in an array may be altered to change and/or optimise performance of the profile. We have found in some embodiments that the width W of a formation or projection may be from 0.2P to P or less than P, preferably from 0.25P to 0.75P and most preferably from 0.4P to 0.6P. We have found that this range of width W leads to improved performance of the profile.

The length L of a formation or projection may be 3 to 20 times the base gauge G of the sheet material. Preferably, the length L is from 5 to 1 times the base gauge G of the sheet material.

We prefer to use a sheet material with a base gauge G of from 0.2 to 3 mm, preferably 0.3 to 3 mm. When forming profiles for stud walls we preferably use a sheet material with a base gauge G of from 0.2, 0.3 or 0.4 to 1.5 mm, say from 0.2, 0.3 or 0.4 to 1.2 mm. As the base gauge G increases above a base gauge G of 1.2 mm or 1.5 mm any so-formed profile may start to be usable as a structural element.

The first or base portion may comprise one or more longitudinal ribs. The first or base portion may comprise castellations. The castellations may be raised with respect to a neutral plane. Preferably the or a neutral plane of the base portion may be defined by a first and/or second outboard portion. If present, the castellations may be in-board of the out board portions. Joining portions are provided between each element of the castellations. One or more projections may be provided along one or more of the joining portions.

The third portion may have a principal axis parallel to that of the profile. The second portion may have a principal axis parallel to that of the profile. The second portion may extend, in a direction orthogonal to the principal axis of the profile, further than does the third portion, or vice versa.

We have surprisingly found that a profile provided with an array of embossed projections at a joining portion can perform better than a profile with a continuous elongate rib at a joining portion. We believe that this is through an effect of balancing the structural characteristic of the embossment with the thinning effect that naturally occurs as a result of embossing. Indeed, with a pitch of projections of from 2 to 20 times the gauge (e.g. from 5 to 15 times the gauge) and, in at least some embodiments, having a form depth of say from >1 to 4 times the gauge (e.g. from 1.8 to 3 times the gauge), the profile of the invention will demonstrate an increase in the second moment of area comparable to that obtained from a profile having a continuous rib. However the performance of the profile of the invention will be improved because, in contrast to the profile having a continuous rib, the profile of the invention does not have a continuous line of thinning running along its length (the thinning being caused by the embossing process). In the field of dry constructions this is beneficial, especially when seeking to alleviate the problem of, say, board stepping.

A yet further aspect of the invention provides an elongate profile having a first portion and a second portion, the first and second portions being joined together at a first joining portion, the first and second portions being non collinear or non coplanar, the joining portion comprising an elongate embossment, the first a second portions being work hardened and each comprising an array of projections and depressions, the projections one side of a portion corresponding to depressions on the other side of the portion and the projections and depressions being spaced such that there lines drawn on the surface of the portion between the projections are non rectilinear.

A further aspect of the invention provides a tool for embossing a pattern on a sheet material, the tool comprising a first forming portion for forming a first pattern on a sheet material and a second forming portion for forming a second pattern on the sheet material, the first forming portion comprising a first array of projections and the second forming portion comprising a second array of projections.

Another aspect of the invention provides a tool for embossing a pattern on a sheet material, the tool comprising a first forming portion for forming a first pattern on a sheet material and a second forming portion for forming a second pattern on the sheet material, the first forming portion comprising a first array of projections and the second forming portion comprising a second array of rebates.

The first forming portion and second forming portion have distinct shapes, such that, in use, the first pattern and second pattern formed on a sheet are distinct. In embodiments, each of the first and second forming portions may be configured to form their respective pattern along a forming direction, for example wherein the second forming portion may be adjacent, abutting or spaced from the first forming portion in a direction orthogonal to the forming direction. The first forming portion may be beside the second forming portion and in some embodiments, the first forming portion includes an interruption in which the second forming portion is located or situated. The tool may comprise two first forming portions between which the second forming portion may be located, for example such that it is at least partially surrounded or confined or bound by the first forming portions.

A yet further aspect of the invention provides a pair of tools for forming a pattern on sheet material, the first tool comprising a first forming portion for forming at least part of a first pattern on a sheet material and a second forming portion for forming at least part of a second pattern on the sheet material, the first forming portion comprising a first array of projections and the second forming portion comprising a second array of projections, the second tool comprising a third forming portion for forming at least part of said first pattern on the sheet material and a fourth forming portion for forming at least part of said second pattern on the sheet material, the third forming portion comprising a third array of projections and the fourth forming portion comprising an array of rebates, the second forming portion and the fourth forming portion being co-operable to emboss a pattern corresponding to the respective array of projections and rebates on the sheet material.

The first and third forming portions of the tools may co-operable to cold work harden the sheet material to form an array of projections.

Preferably the tools are mounted for contra-rotation and, when so mounted, the first and third forming portions may intermesh for example such that as the first and second tools rotate the first array of projections engages gaps between the third array of projections and vice versa. At least one or each tool may comprise a roll and/or be cylindrical. The second forming portion may be surrounded or confined or bound by the first forming portion or portions in an axial direction or a direction along the axis of rotation of the tool, without being surrounded or confined or bound by the first forming portion or portions in a circumferential direction or rolling or working direction. At least one or each tool may comprise a series of parts or segments, e.g. along its axis of rotation, each with a respective first or second forming portion, for example such that the tool comprises alternating first and second forming portions.

Another aspect of the invention provides a use of a pair of tools, for example the pair of tools described above, wherein the tools are contra-rotated and sheet material may be passed between the tools as they contra-rotate and wherein the or a second and forth forming portions emboss the sheet material and wherein simultaneously the or a first and third forming portions work harden the sheet material.

A further aspect of the invention provides a method of treating sheet material, the method comprising passing sheet material between cooperating first and second tools, each tool having a first portion for embossing sheet material in a first region and a second portion for shaping the sheet material in a second region, and embossing the sheet material in the first region whilst simultaneously shaping the sheet material in the second region.

A yet further aspect of the invention provides a method of forming a sheet material, the method comprising the steps of placing or running a sheet material between a pair of tools and moving the tools such that the tools, e.g. respective first forming portions thereof, form a first pattern in a first portion of the sheet material and such that the tools, e.g. respective second forming portions thereof, form a second pattern that is or may be different from the first pattern in a second portion of the sheet material.

According to another aspect of the invention, there is provided a method of forming a sheet material, the method comprising the steps of placing or running a sheet material between a pair of tools and moving the tools such that the tools, e.g. respective first forming portions thereof, cold work a first portion of the sheet material and such that the tools, e.g. respective second forming portions thereof, emboss a second portion of the sheet material. The embossment preferably protrudes out of the plane of the sheet material, for example a neutral plane thereof.

Yet another aspect of the invention provides a forming tool for forming sheet material, e.g. for use in a method according to any preceding claim, the forming tool comprising a first forming surface, which may be configured to form a first pattern and/or cold work, in use, a sheet material or a first portion thereof, and a second forming surface, which may be configured to form a second pattern that may be different from the first pattern and/or emboss the sheet material or a second portion thereof.

A further aspect of the invention provides a pair of forming tools for forming sheet material therebetween, e.g. for use in a method as described above.

A yet further aspect of the invention provides a pair of forming tools for forming sheet material, e.g. for use in a method as described above, each forming tool comprising a first forming surface and a second forming surface, wherein the first forming surfaces of the forming tools may be configured to cooperate, in use, to cold work a sheet material therebetween and the second forming surfaces of the forming tools may be configured to cooperate to emboss the sheet material therebetween, for example such that the embossed feature or features protrude out of the plane of the sheet material, for example a neutral plane thereof.

Another aspect of the invention provides a pair of forming tools for forming sheet material therebetween, e.g. one or each of which may comprise a forming tool as described above, each of the forming tools comprising a respective first forming surface and a respective second forming surface, wherein the first forming surfaces cooperate, in use, to form a pattern while the second forming surfaces cooperate to form, e.g. simultaneously, a second pattern.

Yet another aspect of the invention provides an apparatus for forming sheet material, the apparatus comprising a pair of opposed tools, e.g. as described above. The tools are preferably movable relative to one another, which tools may each comprise or be provided with forming surfaces, e.g. forming projections or teeth that may be configured or able to intermesh with forming projections or teeth on the other tool. In embodiments where the apparatus comprises a pair of opposed tools as described above, the first forming surfaces may comprise projections or teeth and the geometry and/or position of the projections or teeth and/or the spacing of the tools is such that the projections or teeth on one tool register and/or extend, in use, into gaps between the projections or teeth on the other tool.

Another aspect of the invention provides an apparatus for forming sheet material, e.g. a cold rolling apparatus, the apparatus comprising first and second tools, each being provided with forming projections which are able to intermesh with forming projections on the other, the tools being operable to pattern a sheet material in use, each tool having a first end and a second end and each having driving means located at or toward one of the first and second end the other end being free of driving means, the driving means in use, intermeshing to allow the tools to be driven.

Each of the first and second tool may comprise an aperture for receiving a shaft.

Yet another aspect of the invention provides a forming tool for forming sheet material, for example for use in an apparatus as described above, e.g. a tool for cold rolling, the tool being provided with forming projections which are able to intermesh with forming projections on another tool to pattern a sheet material in use, the tool having a first end and a second end, driving means being located at or toward one of the first and second end the other end being free of driving means.

The tool may comprise an aperture for receiving a shaft.

It has been surprisingly found that rather than introducing a potential destabilising force when driving the rolls, having driving means at one end of the rolls rather than both does not have a deleterious effect on registration accuracy and continuing alignment of the patterned sheet material and also reduces the cost of the roll and associated drive means (motors, gear chains etc.) and the setup up time.

The driving means preferably comprise gears, for example spur gears.

The method may comprise providing on the first and second tools in the respective second portions plural male forming members.

Preferably said shaping comprises work hardening the sheet material in the second region. It is particularly preferred to deploy, as the work hardening method, the method disclosed in GB2450765.

Alternatively or additionally said shaping may comprise knurling and or embossing the sheet material in the second region. If the shaping in the second region involves embossing, the embossing will usually be such as to result in a different pattern to that provided in the first portion.

In order that the invention may be more fully understood it will now be described, by way of example only and with reference to the accompanying drawings, in which:

FIG. 2 is an isometric view of a further embodiment of the invention;

FIG. 2A is an end elevation of the profile of FIG. 2;

FIG. 2B is an enlarged view of a part of FIG. 2;

FIG. 2C is a plan view of the profile of FIG. 2;

Figure 1:
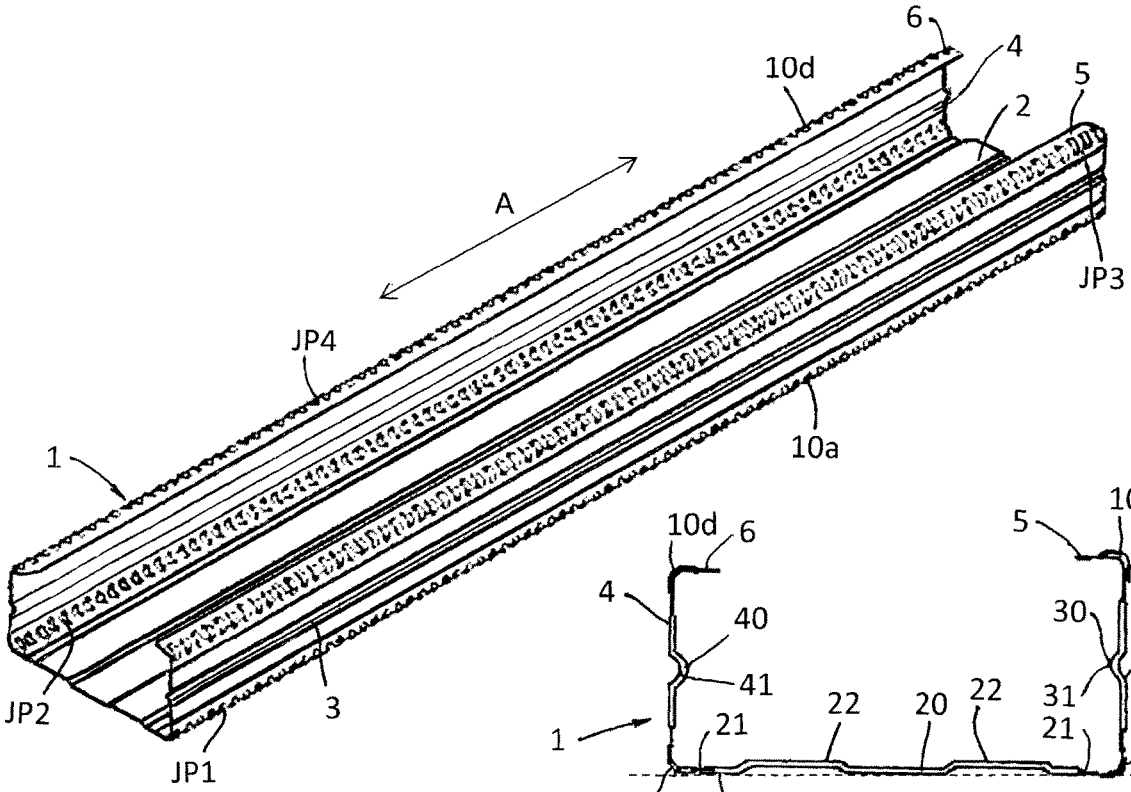
FIG. 1 is an isometric view of a profile according to the invention.
Figure 1A:
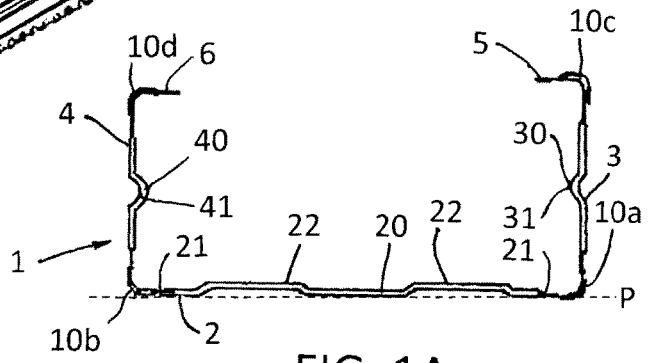
FIG. 1A is an end elevation of the profile of FIG. 1.
Figure 1B:
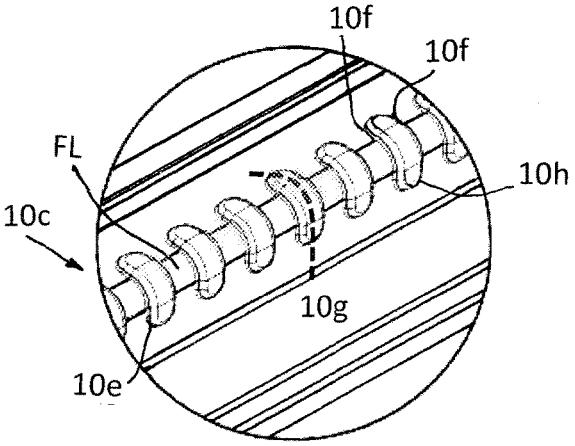
FIG. 1B is an enlarged view of a part of the profile of FIG. 1.

Referring to FIGS. 1, 1A and 1B there is shown a profile 1. The profile 1 of the form shown is termed a C profile. The profile 1 has a base portion 2 from which extends a pair of parallel side portions 3, 4. The side portions 3, 4 respectively terminate with in-turned flanges or ledge portions 5, 6 which overlie the base portion 2.

The base portion 2 has a neutral plane, designated P in the drawings. The base portion 2 comprises a central region 20 and a pair of outboard regions 21. Between the central region 20 and each outbound region 21 is a rebated portion 22 to provide, when looking along the profile (see FIG. 1A), a castellated effect.

The side portions 3, 4 each have an elongate inwardly directed rib 30, 40 respectively extending along the length thereof.

The first side portion 3 is of greater area, i.e. it extends further from the base portion 2 in a direction orthogonal to the neutral plane P (and to the direction of the principal axis A of the profile 1), than does the second side portion 4. Also the rib 30 of the first side portion 3 is smaller than the rib 40 of the second side portion 4. The apex 31 of the rib 30 is positioned the same distance from the base portion 2 than is the apex 41 of the other rib 40. The reason for the differences will become apparent. It is also within the scope that the ribs are position at slightly different positions with respect to the neutral plane P and/or with respect to one another.

As a consequence of the different extensions of side portions 3, 4 from the base portion 1, the respective ledge portions 5, 6 are parallel to each other (and to the neutral plane P) but are located at different distances (in a direction orthogonal to the neutral plane P) from the base portion 2.

At each position where a portion 2, 3, 4, 5, 6 joins to another portion (2, 3, 4, 5, 6) there is a joining portion JP1, JP2, JP3, JP4. The material in the region of each joining portion JP1-4 may be, overall, thinner than in the adjacent portions 2-6. In the above and below description a 'joining portion' is intended to mean a part which joins two elements of a profile the planes of which elements describe an angle therebetween of, or greater than, 30° (in the embodiment of FIG. 1 the angle is at or about 90°), whereas a 'join' is intended to mean a part which joins two elements of a profile, the planes of which describe an angle therebetween of less than 30°, for example the two elements may be parallel but non-co-linear or non-co-planar.

Located as a longitudinal array 10 along each joining portion JP1-4 is a series of formations, namely outwardly extending protuberances or projections, 10*a-d* respectively. As is best seen in FIG. 1B, each one of the substantially identical projections 10*e* of the series of projections 10*a-d* (a part of series 10*c* is shown) is rectangular with parallel sides 10*f* and with a principal axis 10*g* orthogonal to the principal longitudinal axis A of the profile 1 and with rounded ends 10*h*.

As shown, each of the projections 10*e* extends outwardly from the surface of each of the joining portions JP1-4 (i.e. the projections 10 radiate or extend away from one another) and is curved around the respective bend in the profile 1 (that is at the respective joining portion JP1-4) such that each projection 10*e* is substantially L-shaped. Between successive projections are flat lands FL. It will be appreciated that each of the central region 20 and rebated portions 22 and outboard regions 21 are non-collinear or non-coplanar. It is within the scope of this invention, that a profile 1 comprising 'joins' and/or 'joining portions' wherein one, some, both or all the joins and/or joining portions comprise one or more embossed projections will fall within the scope of the invention.

The surface of one or more of the portions 2, 3, 4, 5, 6 may be work hardened, embossed or knurled. It is preferred that at least one, some and most preferably all of the surface of the portions 2, 3, 4, 5, 6 are cold rolled and work-hardened, for example using a method set out in one of our patent applications GB2450765A, EP0891234A.

For the avoidance of doubt and as would be appreciated by the skilled person, the term 'cold working' (also known as 'cold work hardening') as used herein refers to the deformation of metal plastically at a temperature below its lowest recrystallisation temperature, where strain hardening occurs as a result of such permanent deformation. In addition, the term 'embossing' as used herein refers to the operation of raising a design or form above and/or below the surface of a component by means of high pressure effected by pressing or squeezing action, and includes debossing.

It is known that embossing and cold work hardening are distinct techniques. Embossing involves compressing material, in this case sheet metal, between two tools (e.g. rolls) to reduce its thickness beyond its ultimate tensile strength into the purely plastic range; it is a compression process which uses significant force to squeeze the material between two tools (e.g. rolls), one of which has a projection (or rebate) and the other has a rebate (or projection) whereby the pattern on the tool (e.g. roll) is transferred to the material. In contrast, work hardening by cold roll forming involves plastic strain hardening a material by locally stretching the material without compression. It is conveniently achieved in our above-identified patent applications by using pairs of matched male forming rolls with the teeth of one of the rolls extending (as the rolls rotate) into gaps between teeth on the other roll. Clearly, the skilled person knows and recognises that the techniques are distinct and generate different effects. For example, because of the thinning that occurs with embossing processes embossing is not usually used to work harden or strengthen a sheet material. Other surface effecting processes include knurling and coining. Knurling involves pressing a series of sharp serrations on a hardened steel roller into a work-piece, effectively displacing the material sideways using serrations or projections, rather than pushing projections through the other side of the sheet. This has the effect of roughening the surface, for example to increase surface roughness/friction coefficient, but does not materially alter the strength or stiffness of the work-piece (in some cases it may weaken the material).

Because one side portion 3 extends further away from the base portion 2 than the other side portion 4 it is easy and convenient to make a box section, as will be described below.

Referring now to FIG. 2 and FIGS. 2A, 2B and 2C there is shown a further profile 1' of the invention.

The profile 1' has a base portion 2' from which extend a pair of parallel side portions 3', 4'. The side portions 3', 4' respectively terminate with in-turned ledge portions 5', 6' which overlie the base portion 2'.

The base portion 2' has a neutral plane, designated P' in the drawings. The base portion 2' comprises a central region 20' and a pair of outboard regions 21'. Between the central region 20' and each outbound region 21' is a rebated portion 22' to provide, when looking along the profile 1' (see FIG. 2A) a castellated effect.

The side portions 3', 4' each have an elongate inwardly directed rib 30', 40' respectively extending along the length thereof.

The first side portion 3' is of greater area, i.e. it extends further from the base portion 2' in a direction orthogonal to the neutral plane P' (and to the direction of the principal axis A' of the profile 1'), than does the second side portion 4'. Also the rib 30' of the first side portion 3' is smaller than the rib 40' of the second side portion 4'. The apex 31' of the rib 30' is positioned slightly further away from the base portion 2' than is the apex 41' of the other rib 40'. The reason for the differences will become apparent.

As a consequence of the different extensions of side portions 3', 4' from the base portion 1', the respective ledge portions 5', 6' are parallel but are located at different distances (in a direction orthogonal to the neutral plane P') from the base portion 2'.

At each position where a portion 2', 3', 4', 5', 6' joins to another portion (2', 3', 4', 5', 6') there is a joining portion JP1', JP2', JP3', JP4'. The material in the region of each joining portion JP1'-4' may be, overall, thinner than in the adjacent portions 2'-6'.

Located as a longitudinal array 10' along each joining portion JP1'-4' is a series of inwardly extending protuberances or projections 10*a*'-d' respectively. As is best seen in FIG. 2B, each one of the substantially identical projections 10*e*' of the series of projections 10*a*'-d' (a part of series 10*c*' is shown) is rectangular with parallel sides 10*f* and with a principal axis 10*g*' orthogonal to the principal longitudinal axis A' of the profile 1' and with rounded ends 10*h*'.

As shown, the projections 10*e*' extend inwardly from the surface of each of the joining portions JP1'-4' and are curved around the bends in the profile 1' (that is at the respective joining portion JP1'-4') such that each projection 10*e*' is substantially L shaped. Between successive projections are flat lands FL'.

As well as projections 10*e*' in the joining portions JP1'-4', there is also an array projections 10*e*' along each of joins J1'-4' between each of the central region 20' and rebated portion 22' and between each outboard region 21' and its adjacent rebated portion 22'. It will be appreciated that each of the central region 20' and rebated portion 22' and outboard region 21' and rebated portion 22' are non-collinear or non-coplanar. It is within the scope of this invention, that a profile comprising 'joins' and/or 'joining portions' wherein both or either the joins and/or joining portions comprise one or more embossed projections will fall within the scope of the invention.

As well as having the embossed rebates 10', substantially the entire surface of the side portions 3' and 4' has been knurled KP, to provide a surface roughening effect on the outermost surface of each side portion 3', 4'. Alternatively, the or any of the portions 2, 3, 4, 5, 6 could, preferably, have been work hardened in accordance with our above-identified patent applications.

Whilst in FIG. 1 all of the projections 10*e* are outwardly facing and are only provided at the joining portions JP1-4, it will be appreciated that projections 10*e* may be inwardly directed and may be provided at the joins between rebated portions 22 and central 20 and/or outboard regions 21, as is shown in FIG. 2D. Also, in each embodiment (FIG. 1, FIG. 2) fewer arrays of projections 10 could be present. Moreover, in each of the embodiments of FIG. 1 or 2, some or all of the projections 10*e*, 10*e*' may extend inwardly or outwardly and some or all of the others outwardly or inwardly. For example, the projections 10*e* in an array 10 may alternate between inwardly and outwardly directed projections. Alternatively or additionally, some or all of the projections 10*e* of a first array may extend inwardly and some or all of those of a second array may extend outwardly.

Figure 3:
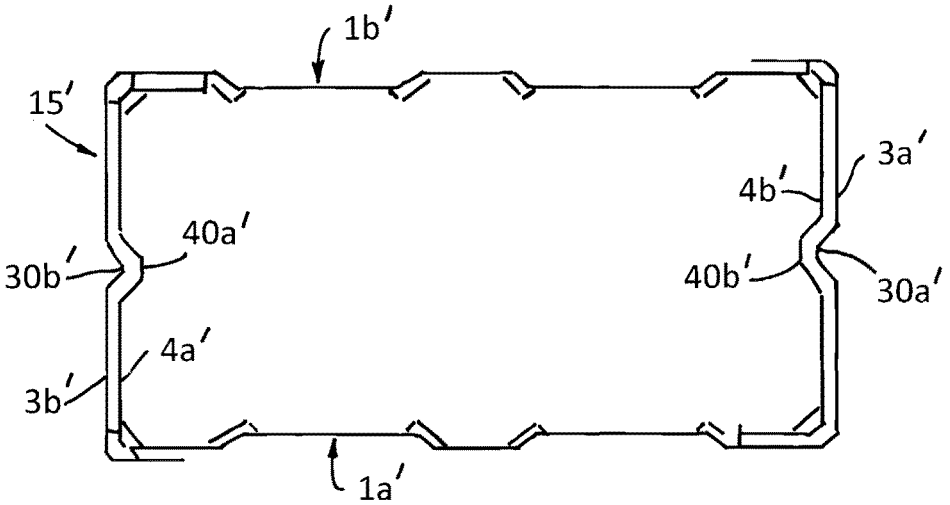
FIG. 3 is a plan view of a box section formed from profiles according to the invention.

Referring to the profile of FIG. 2 (although equally applicable to the profile 1 of FIG. 1) because one side portion 3' extends further away from the base portion 2' than the other side portion 4' it is easy and convenient to make a box section 15', as shown in FIG. 3. With two profiles 1*a*', 1*b*' brought into facing and abutting relations the longer side portion 3*a*' of the first profile 1*a*' is able to embrace the shorter side portion 4*b*' of the second profile 1*b*', and vice versa. In this configuration the rib 30*a*' of the first side portion 3*a*' of the first profile 1*a*' projects into the space defined by the rib 40*b*' of the second side portion 4*b*' of the second profile 1*b*'. Because of the array of projections 10*a*'-d' on each profile 1*a*', 1*b*' and the engaging ribs 30*a*', 40*b*' and 30*b*', 40*a*' there is significant interference between engaged profiles 1*a*', *b*', thereby ensuring that profiles 1*a*', 1*b*' are securely held together. Additionally or alternatively, because the larger side portions 3*a*', 3*b*' embrace the smaller side portions 4*b*', 4*a*' and/or because the profiles 1*a*', 1*b*' snugly engage, the so-formed box section is robust and will not slip longitudinally with respect to one another.

Figure 4:
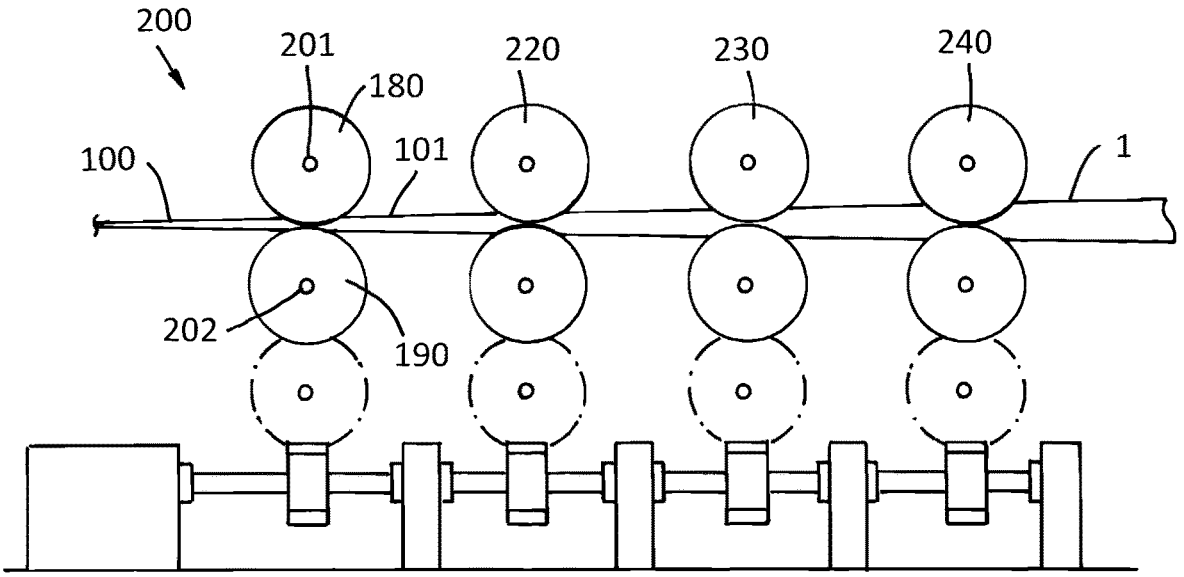
FIG. 4 is a schematic diagram of forming apparatus according to the invention

The profile 1, 1' of the invention is formed from flat sheet material, typically supplied from a coil. Reference is made to FIG. 4 wherein sheet material 100 supplied from a coil (not shown) is passed through a series of roll pairs 200, 220, 230, 240. Usually there will be more than four pairs, and, for forming the specific profile 1 of FIG. 1, one would expect between 12 and 15 pairs of rollers, for example 14 pairs. For forming an I-beam one might expect 18 roller pairs.

The sheet material 100 is first passed through a pair of embossing rollers 200 comprising a first roll 180 and a second roll 190 contra rotating about respective axes 201, 202. The embossing roller pair 200 causes the sheet material 100 to become embossed to provide an embossed sheet material 101, which may be subsequently shaped to form a profile 1 of the invention.

Passage of the embossed sheet material 101 through successive pairs of rollers 220, 230, 240 causes the castellations (20, 21) on the base portion 2, elongate ribs 30, 40 and folds the side portions 3, 4, and ledge portions 5, 6.

As can be seen, the rollers 220, 230, 240 successively bend the sheet material 101 in the region of the joining portions JP 1-4 to form the embossed projections into L-shaped projections 10*e*.

Whilst the above description describes the manufacture of a profile 1 with plain surfaces 2, 3, 4 it is possible to provide a profile with one or more knurled portions (as per the profile 1' shown in FIG. 2) or with embossed and/or work hardened portions. If the knurled profile is required, the knurling operation may take place upstream or downstream of the embossing rolls 200 or, alternatively, the parts of the roll 180 (and/or 190) may be provided with knurling sections outboard of the embossing sections.

If it is desired to provide a profile having work hardened portions, for example work hardened in accordance with one of the methods disclosed in one of GB2450765A or EP0891234A, it is possible to work harden the sheet material upstream or downstream of the embossing roll pair 200. However, we prefer, for reasons of efficiency, to emboss and work harden the sheet material 100 simultaneously.

Figure 5:
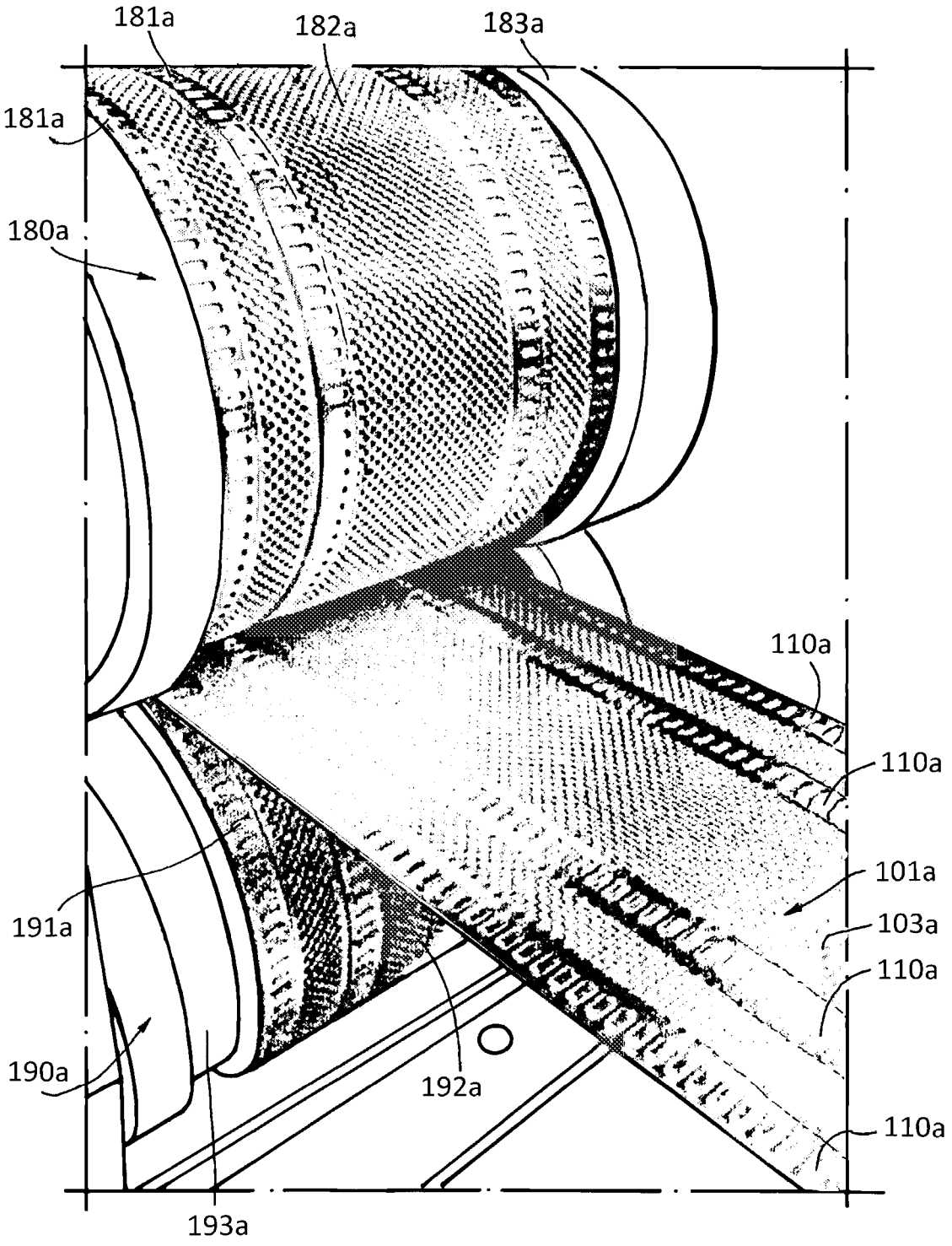
FIG. 5 is a photograph of embossing equipment according to the invention.

Reference is made to FIG. 5, which shows a simultaneous embossing and work hardening roll pair 200*a*. The first, upper (as shown), roll 180*a* carries plural (four shown) circumferential series of radial rebates 181*a* distributed along the circumferential surface 182*a* of the roll 180*a*. The second, lower, roll 190*a* has equivalent plural circumferential series of projections 191*a*, correspondingly distributed such that the rebates 181*a* and projections 191*a* cooperate in use.

Passage of the sheet material 100 between the matched rolls 180*a*, 190*a* causes the projections 191*a* to emboss the sheet material 100 by stretching and forcing sheet material into the rebates 181*a* on the upper roll 180*a*, thereby forming a flat sheet material 101*a* having plural columns of embossed projections 110*a*, one column corresponding to each circumferential series of rebates 181*a* on the first roll 180*a* and corresponding series of projections 191*a* on the second roll 190*a*.

Out board of the embossing regions 181*a*, 191*a*, each roll 180*a*, 190*a* carries a series of male forming elements in respective work-hardening regions 182*a*, 192*a*. The male formers on one roll intermesh with those of the other roll such that as the rolls 180*a*, 190*a* contra-rotate the male formers of one roll extend into spaces between the male formers on the other roll, and vice versa. The work hardening may be undertaken in accordance with one or more methods described in our earlier patent applications, GB2450765A or EP0891234A, and preferably in accordance with EP2091674.

In order to help with the alignment of the rolls 180*a*, 190*a*, one roll (e.g. 180*a*) may be provided with peripheral extension portions (e.g. as indicated at 183*a*) which are able to travel in peripheral matched rebate portions (e.g. as indicated at 193*a*) on the other roll (e.g. 190*a*).

The sheet material may be formed into a C-profile, for example as shown in relation to FIG. 1.

Figure 6:
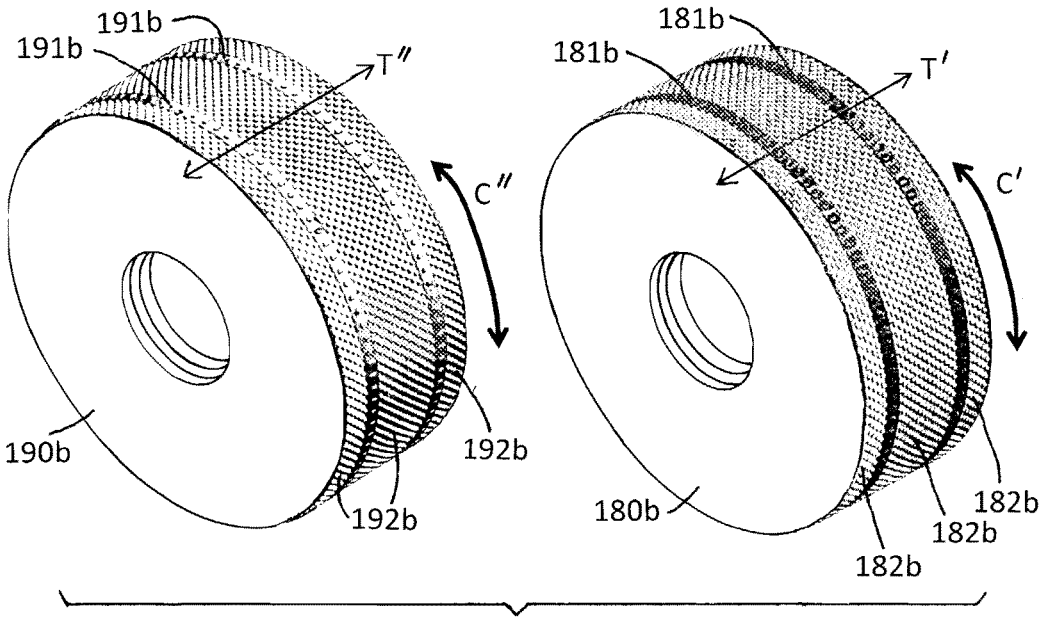
FIG. 6 is a perspective view of apparatus according to the invention.
Figure 6B:
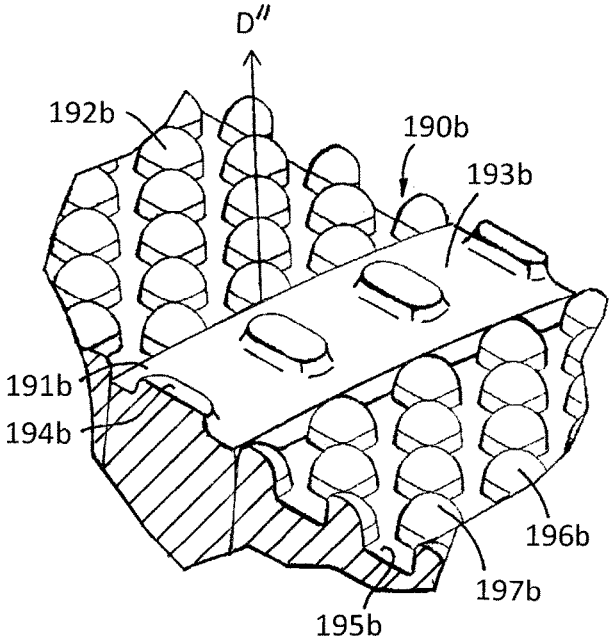
FIG. 6B is a detailed view of a further part of FIG. 6.
Figure 6A:
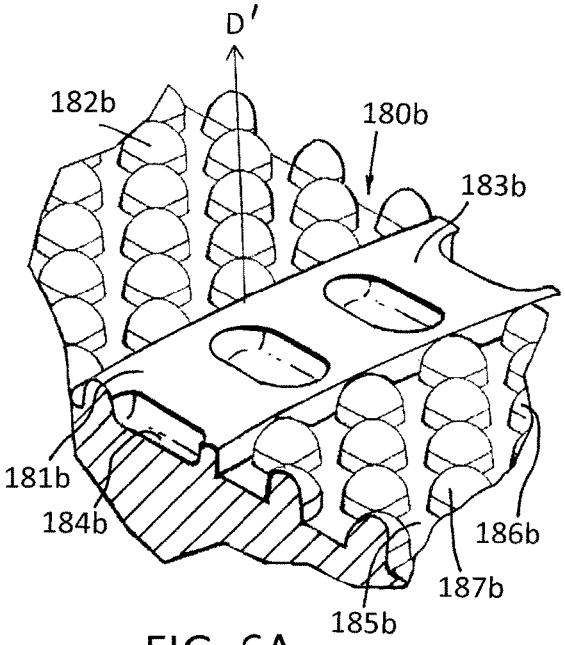
FIG. 6A is a detailed view of part of FIG. 6.
Figure 7:
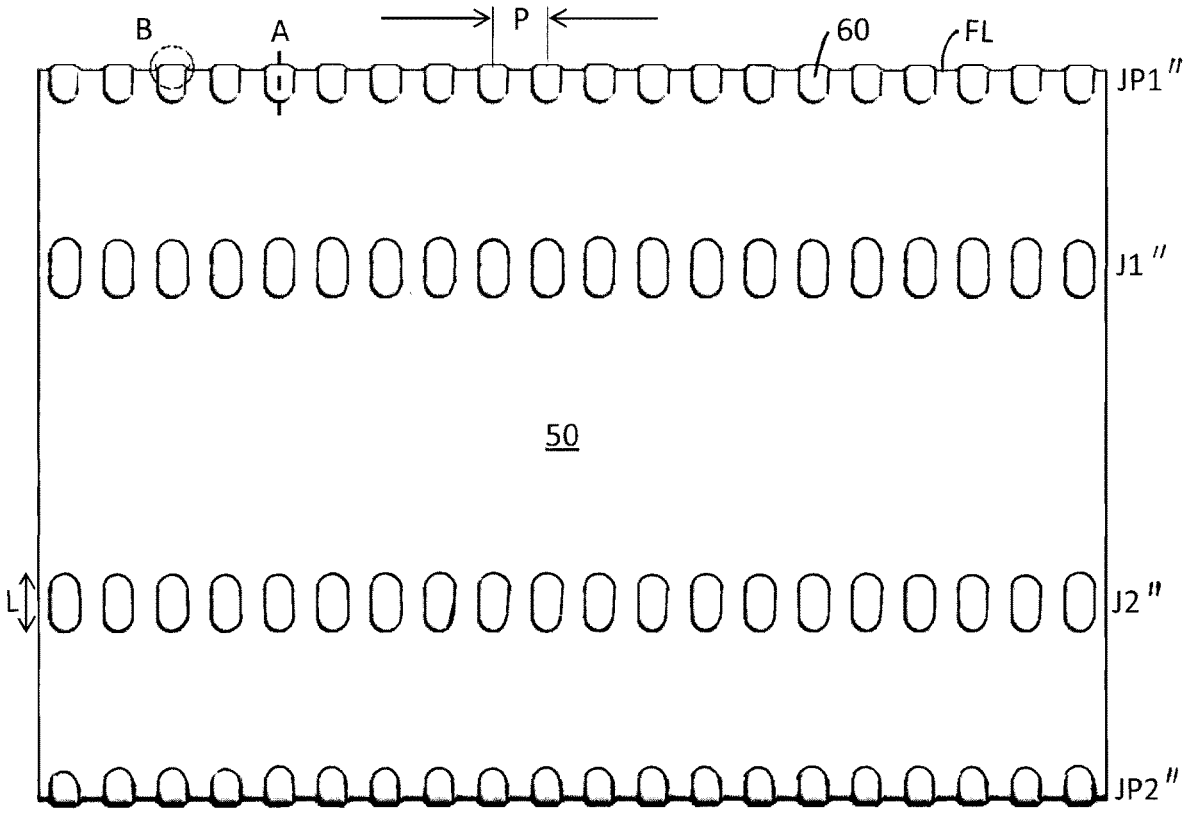
FIG. 7 is a plan view of a profile according to the invention.
Figure 7A:
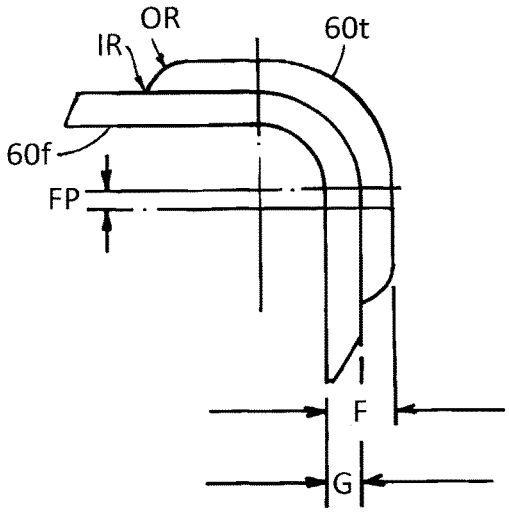
FIG. 7A is a sectional view through a part of the profile of FIG. 7.
Figure 7B:
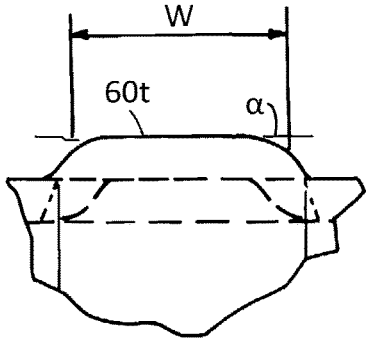
FIG. 7B is a magnified view of a part of the profile of FIG. 7.

FIG. 6 and FIGS. 6A and 6B show details of embossing rolls according to the invention which are capable of embossing and work hardening sheet material as it passes between them.

Referring first to FIG. 6, there is shown a first roll 180*b* having two embossing regions 181*b* comprising a series of circumferential rebates. Outboard of the embossing region 181*b*, the roll 180*b* has three work hardening regions 182*b* comprising a series of male forming elements. There is also shown a second roll 190*b* having two embossing regions 191*b* comprising a series of circumferential projections. Outboard of the embossing region 191*b*, the roll 190*b* has three work hardening regions 192*b* comprising a series of male forming elements.

Referring now to FIG. 6A, there is shown a section of the first roll 180*b*, including a part of an embossing region 181*b* and a work hardening region 182*b*. In the work hardening region 182*b* the roll 180*b* has a base or root 185*b* from which upstands plural male forming members 186*b*. The roll 180*b* has a circumferential direction C' and a transverse direction T' and rows 187*b* of male forming members 186*b* are provided which extend in a direction D' between the circumferential direction C' and the transverse direction T'.

The embossed region 181*b* comprises a band having a surface 183*b* which is raised with respect to the root 185*b* of the roll 180*b* (i.e. the surface 183*b* is radially further from the centre of the roll 180*b* than the root 185*b*). Extending into the surface 183*b* are a series of rebates 184*b*, each being rectangular with parallel sides extending in the transverse direction T' and with rounded ends.

Referring now to FIG. 6B, there is shown a section of the second roll 190*b*, including a part of an embossing region 191*b* and a work hardening region 192*b*. In the work hardening region 192*b* the roll 190*b* has a base or root 195*b* from which upstands plural male forming members 196*b*. The roll 190*b* has a circumferential direction C" and a transverse direction T" and rows 197*b* of male forming members 196*b* are provided which extend in a direction D" between the circumferential direction C" and the transverse direction T".

The embossed region 191*b* comprises a band having a surface 193*b* which is raised with respect to the root 195*b* of the roll 190*b* (i.e. the surface 193*b* is radially further from the centre of the roll 190*b* than the root 195*b*). Extending from the surface 193*b* are a series of projections 194*b*, each being rectangular with parallel sides extending in the transverse direction T' and with rounded ends.

In use, the rolls 180*b*, 190*b* are aligned such that the male formers 186*b* of the first roll 180*b* intermesh with male formers 196*b* of the second roll 190*b* and the projections 194*b* of the second roll at least partially extend into the rebates 184*b* of the first roll 180*b*.

When sheet material is passed between the rolls 180*b*, 190*b* the sheet material is embossed between the cooperating embossing regions 181*b*, 191*b* and work hardened in the cooperating work hardening regions 182*b*, 192*b*. In the embossing regions, the sheet material is gripped between the facing surfaces 183*b*, 193*b* and stretched in the region of the projections 194*b* and rebates 184*b* to assume the shape of the projections 194*b*. In each of the work hardening regions the sheet material does not contact the root 185*b*, 195*b* of either roll 180*b*, 190*b* but is locally stretched to work harden the material by action of the intermeshing male members 182*b*, 192*b*, that is to say there is no compression of the sheet material between a projection 182*b* (or 192*b*) on one roll 180*b* (or 190*b*) and the root 195*b* (or 185*b*) of the other roll 190*b* (or 180*b*). In other words, when the tools intermesh there is a clearance between the peaks of the projections (e.g. 182*b*) on one roll (e.g. 180*b*) and the root (e.g. 195*b*) on the other roll (e.g. 190*b*) which is equal to, or preferably greater than the base gauge of the sheet material to be processed. In contrast, in the embossing regions, there is no such clearance. It is by virtue of the respective configurations (i.e. that the surface 183*b* of the band is raised with respect to the root 185*b*, and that the surface 193*b* of the band is raised with respect to the root 195*b*) that embossing is effected in that region and that because there is adequate clearance between the facing rollers in the cold work hardening regions that the sheet material is work hardened in those regions.

It is hugely advantageous to be able to conduct each of the distinct forming methodologies in a single pass through one set of rollers 180, 190.

The profile 1, for example where one or more of the base 2, side portions 3, 4, ledge portions 5, 6 are work hardened, and formed in accordance with the invention, has better compression characteristics than those absent the array of projections 10*a-d*.

This is surprising because the profile has not been work hardened in the joining portions but rather has been embossed, which leads to thinning. It is the joining portions which are required to withstand deflecting forces. Consequently, one would expect a deterioration in the compression characteristics, as compared to a profile which had been work hardened or which had not been processed (embossed) at all.

Referring to FIGS. 7, 7A, 7B and 7C, there is shown a profile 50 according to the invention with an array of projections 60 along each joining portion JP1", JP2" and joins J1" and J2". The projections 60 extend outwardly from the exterior surface of the profile 50. Whilst not shown, one or more or each or all of the surfaces of the profile 50 (outside of the joins J" and joining portions JP") may be work hardened in accordance with the above description and/or knurled or otherwise treated. We prefer that the surfaces are work hardened. The profile 50 may be a C, U or other shaped section, and the characteristics of the sheet and/or projection(s) described below are equally applicable to other sectional shapes, projection shapes and so on.

The array of projections and each projection 60 has one or more of a pitch P, a width W, a form depth F and a form position FP.

The pitch P is the inter projection (formation) distance. For a sheet material with a gauge G we prefer a pitch P which can be 2 to 20 times the base gauge G and is preferably from 5 to 15 times the base gauge G of the material. Preferably the pitch P is from 6 to 14 times the base gauge G, and most preferably from 8 to 12 times the base gauge G.

The width W of each projection 60 is determined as the linear distance between the intersection of a line denoting a tangent α of the apex of the top surface 60*t* of the projection 60 and lines formed between the start of the root part (e.g. 193*b* in FIG. 6B) of the embossing region (e.g. 191*b* in FIG. 6B) of a roll (e.g. 190*b* in FIG. 6B) when engaging the sheet material to form the projection 60 and the flat portion of the sheet material immediately outboard of the projection. In some embodiments the width W of a projection may be from 0.2P to less than P, preferably from 0.25P to 0.75P and most preferably from 0.4P to 0.6P.

The form depth F is the distance between a first face 60*f* of the sheet material and the top surface 60*t* (or a tangent α of the apex of the top surface 60*t* where the top surface 60*t* is not flat, as shown) of a projection 60. In some embodiments the form depth F of is between 1.5 and 4 times the base gauge G of the material, preferably between 1.6 and 3.5 times the base gauge G and most preferably from 1.8 to 3 times the base gauge G.

The form position FP is defined as the linear distance between the end of the curved part of a projection 60 on a joining portion JP1" (or JP2") and the end of the curved part of the profile 50. In some embodiments the form position FP of a projection may be from 0.2G to G, preferably from 0.25G to 0.75G and most preferably from 0.4G to 0.6G.

In the region of the joining portion JP1" (or JP2") the projection 60 may be curved. Such a curved projection 60 may have an internal radius of curvature IR and an external radius of curvature OR. In some embodiments the internal radius of curvature IR of a projection may be from 0.2G to G, preferably from 0.25G to 0.75G and most preferably from 0.4G to 0.6G. The external radius of curvature may be IR+G.

Because of the nature of the embossment, the sheet material is stretched when forming the projections 10. The resultant thickness RT (for example as measured in the direction of the line XX-XX in FIG. 7C—a line 45° to the principal axis of the sheet material) is preferably from 0.9G to 0.55G where F is from 1.8 to 3G. Because the sheet material is clamped during the embossing process between a male and female former the thickness of the sheet in the region of the top surface 60*t* (i.e. as measured in a direction perpendicular to the principal axis of the sheet material) remains unaltered, or at least substantially so and there is no change in the physical properties of the sheet in that region. Thus, it is the side portions of each projection 10 which experience thinning as a consequence of the embossing operation.

The characteristics described above in relation to FIG. 7 are equally applicable to one or more of the other embodiments. In each case above (and preferably in each case of the invention), flat lands FL are provided between successive members of an array. In the region of the flat lands the sheet material remains at least substantially unaltered.

Figure 8A:
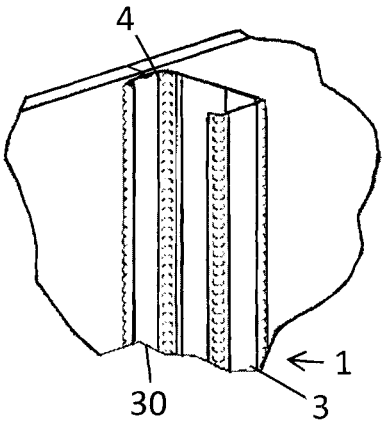
FIG. 8A is a portion of the wall of FIG. 8
Figure 8:
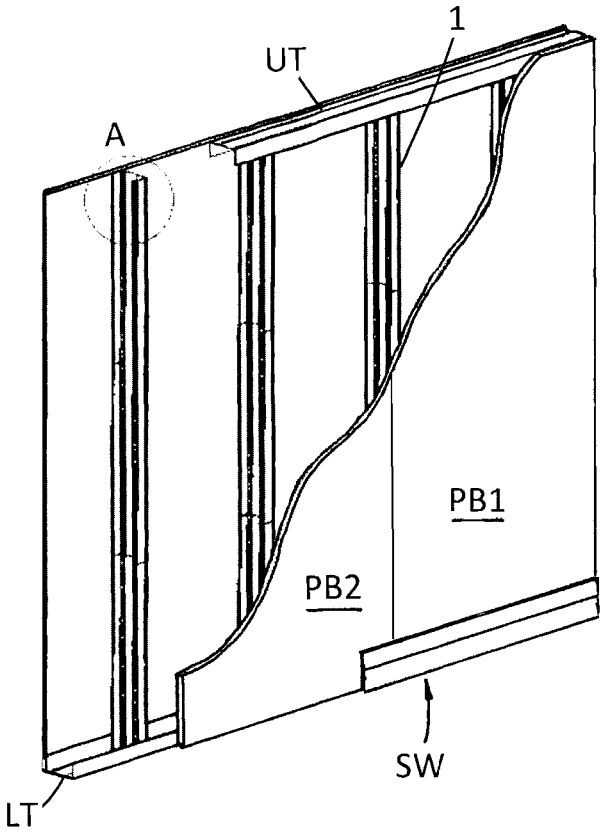
FIG. 8 is a schematic view of a part of a wall incorporating a profile of FIG. 1.
Figure 7C:
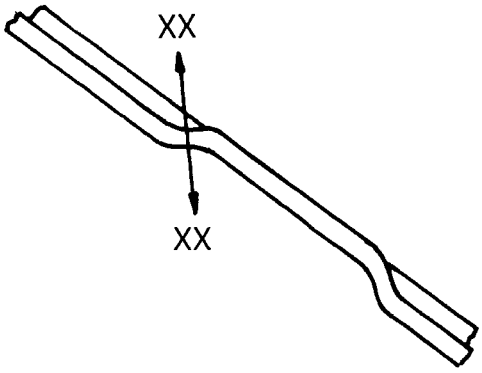
FIG. 7C is a photograph of a section of a part of a profile of FIG. 7.

In FIG. 8 there is shown plural stud profiles 1 in a vertical orientation located between upper and lower horizontal tracks (UT and LT respectively) with lengths of plasterboard PB abutting the first side portion 3 and second side portions 4. As shown, at at least some of the stud profiles 1 an edge of a length of plasterboard PB1 is aligned with the longitudinal rib 30, which can provide a visual location guide to the installer. An edge of a further length of plasterboard PB2 is brought into abutment with the edge of the plaster board PB1, thereby to form part of a stud wall SW. Because of the increased resistance to compression provided by the projections 10*a-d*, the side portions 3, 4 are much less likely to flex, with respect to the base portion 2, when the plasterboard PB1 (and/or the further length PB2) is secured to the profile 1. This has the effect of reducing incidence of the phenomenon known as "board stepping". One or both of the tracks LT, UT can be formed with projections 10 according to the invention. One or some or all of the portions of each profile outside of the joining portions (or joins, if present) may be cold rolled and work hardened, embossed, knurled, coined and so on. We prefer at least some of those portions (and preferably each) to be cold-work hardened, for example as disclosed in our above-identified patents (EP0891234 or EP2091674, preferably the latter), and as shown in relation to FIGS. 5 and 6.

In order to demonstrate the increase in compression resistance a series of tests were carried out, as follows.

EXAMPLE 1

In order to test the stiffness of a single portion of the profile 1 of the invention, one of the wall portions 3 or 4 of a profile according to the invention was loaded and the deflection measured. The profile had the following characteristics, width 63 mm, wall height 32 and 34 mm. The base gauge G was 0.5 mm the projections had a pitch P of 5 mm, and each was 7 mm long, and had a width W of 2.5 mm, a form depth F of 1 mm and RT was 0.4 mm.

The test enabled the stiffness to be calculated. We call this a Single Leg Test.

COMPARATIVE EXAMPLE 1

A profile of identical size and length but absent the projections 10 of the invention was tested in an identical manner.

The results are shown in Table 1.

TABLE 1

Single Leg Test data for Example 1 and Comparative Example 1

| | Deflection (mm) at 50N | Deflection (mm) at 150N | Stiffness (N/mm) | Variation (%) |
|---|---|---|---|---|
| Ex. 1 | 0.667 | 1.967 | 38.5 | (1) |
| C. Ex. 1 | 0.52 | 1.8107 | 38.7 | — |

The data in Table 1 demonstrates that the stiffness of the profile 1 of the invention is practically identical to that of a profile of the prior art. This is a surprising result because the thinning of the material brought about as a result of the embossing would lead one to expect that the stiffness would be reduced in a profile 1 of the invention.

EXAMPLE 2

In order to test the stiffness of both wall portions of the profile 1 of the invention, both of the wall portions 3 or 4 of a sample identical to that described in Example 1 were loaded and the deflection measured, we call this a Double Leg Test. This enabled the stiffness to be calculated.

COMPARATIVE EXAMPLE 2

A profile of identical size and length but absent the projections 10 of the invention was tested in an identical manner.

The results are shown in Table 2.

TABLE 2

Double Leg Test data for Example 2 and Comparative Example 2

| | Deflection (mm) at 50N | Deflection (mm) at 100N | Stiffness (N/mm) | Variation (%) |
|---|---|---|---|---|
| Ex. 2 | 2.255 | 4.83 | 19.4 | 6 |
| C. Ex. 2 | 2.32 | 5.06 | 18.2 | — |

The data of Table 2 demonstrates that the deflection profile and stiffness of the profile 1 of the invention is substantially greater than that of a profile of the prior art. These are surprising results, not least because of the apparent identicality under the Single Leg Test and because of the change of the material brought about as a result of the embossing would suggest that the stiffness would be reduced in a profile 1 of the invention. We believe that this shows a significant improvement over the prior art.

EXAMPLE 3

We conducted some comparative tests on a sample of stud 1 having 'external' projections 10 according to FIG. 1 (Example 3A) and a sample of stud 1' having 'internal' projections 10' according to FIG. 2 (Example 3B). Each of the studs 1, 1' had a base wall 2, 2' of 70 mm, a first side wall 3, 3' of 34 mm, a second side wall 4, 4' of 32 mm and in-turned ledges 5, 5', 6, 6' of 6.5 mm.

Both studs 1, 1' had the same number and array of projections 10, 10' (that being the array shown in FIG. 1 which is projections at each of the joining portions JP1 (of JP1')-JP4 (or JP4')).

The moment of inertia and sectional modulus of each of the studs 1, 1' was determined.

COMPARATIVE EXAMPLE 3

A profile of identical size and shape but absent the projections was tested in an identical manner.

The results are shown in Table 3.

TABLE 3

Data showing the moment of inertia (I) and sectional modulus (Z).

| | $I_{XX}$ ($mm^4$) | $I_{YY}$ ($mm^4$) | $Z_{XX}$ ($mm^3$) | $Z_{YY}$ ($mm^3$) |
|---|---|---|---|---|
| Ex. 3A | 60500 | 10700 | 1650 | 420 |
| Ex. 3B | 58200 | 10100 | 1700 | 450 |
| C. Ex. 3 | 58200 | 9700 | 1650 | 410 |

It can clearly be seen that the moment of inertia I (indicative of the resistance to bending) is higher in both of the examples of the invention by between 4 and 10% and the sectional modulus from 2.5 to 7% (both in the y direction).

Both these results show that a profile made in accordance with the invention is stiffer than a profile made in accordance with the prior art.

To further test the performance of profiles of the invention, we conducted some further tests.

EXAMPLE 4

Figure 9A:
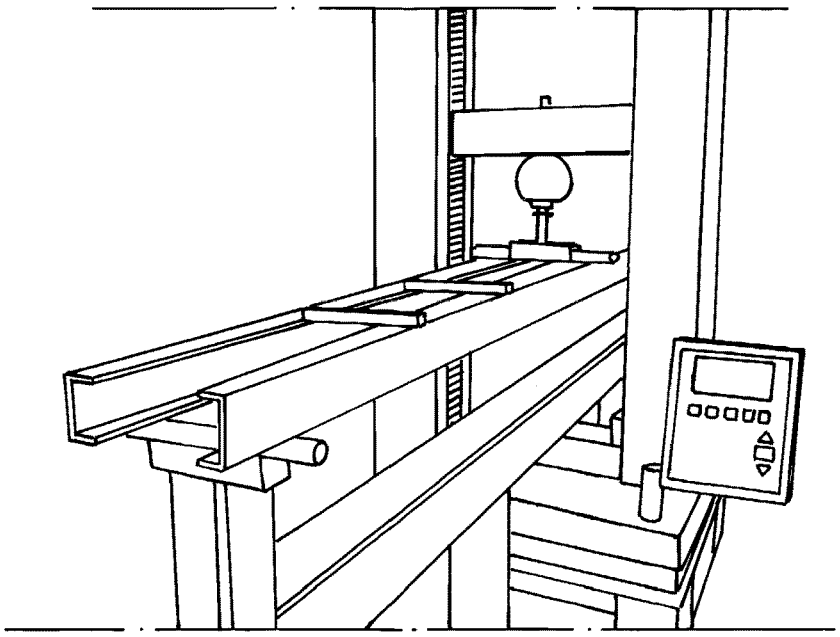
FIGS. 9A to 9C show a test rig for conducting the test of Example 4 with an isometric view of the test rig (FIG. 9A), front elevation of the test rig (FIG. 9B) and side elevation of the test rig (FIG. 9C)
Figure 9B:
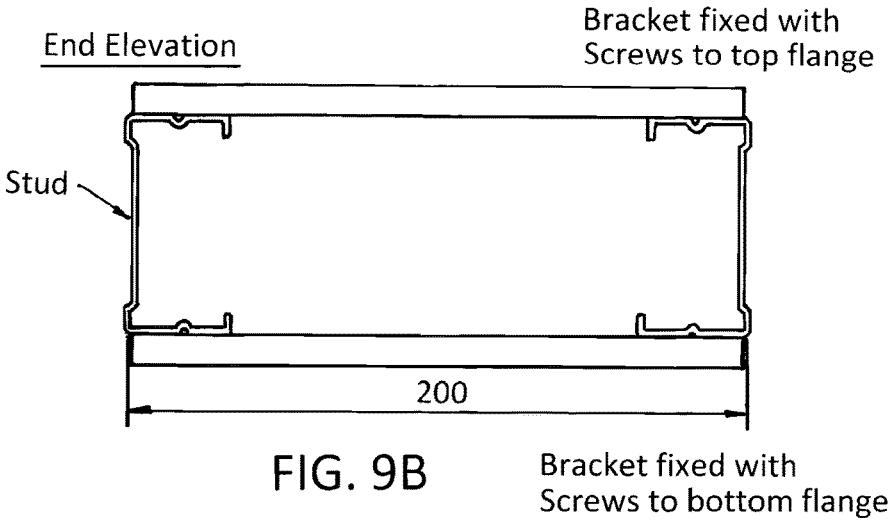
Figure 9C:
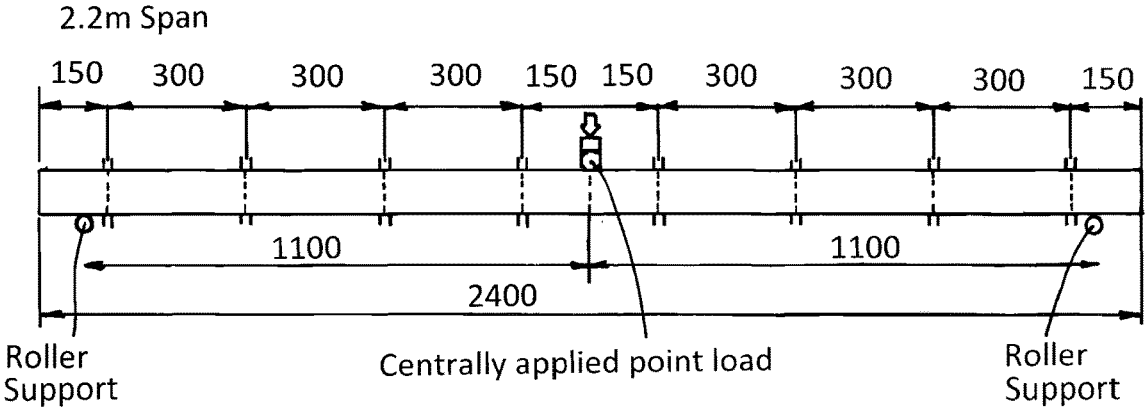

We conducted a series of three point bend tests on plural samples of profiles made according to the invention and formed in accordance with FIG. 1 and Example 1. Pairs of profiles with a length of 2.2 m were mounted as shown in FIGS. 9A to 9C and a load was applied to the mid-point of the pairs of profiles.

COMPARATIVE EXAMPLE 4

A pair of profiles of the same dimensions but absent the projections were tested in the same manner as set out in Example 4.

The results (average of 3 runs in each case) are shown in Table 4.

TABLE 4

Three Point Bend Test data for Example 4 and Comparative Example 4

| | Maximum load (N) | Maximum Extension (mm) | Force @ 3 mm (N) | Force @ 5 mm (N) |
|---|---|---|---|---|
| Ex. 4 | 1338 | 17 | 245 | 430 |
| C. Ex. 4 | 848 | 12 | 226 | 383 |

The results clearly demonstrate that the profile of the invention performed better in terms of its ability to withstand deflecting forces than a profile of the prior art.

EXAMPLE 5

Figure 10:
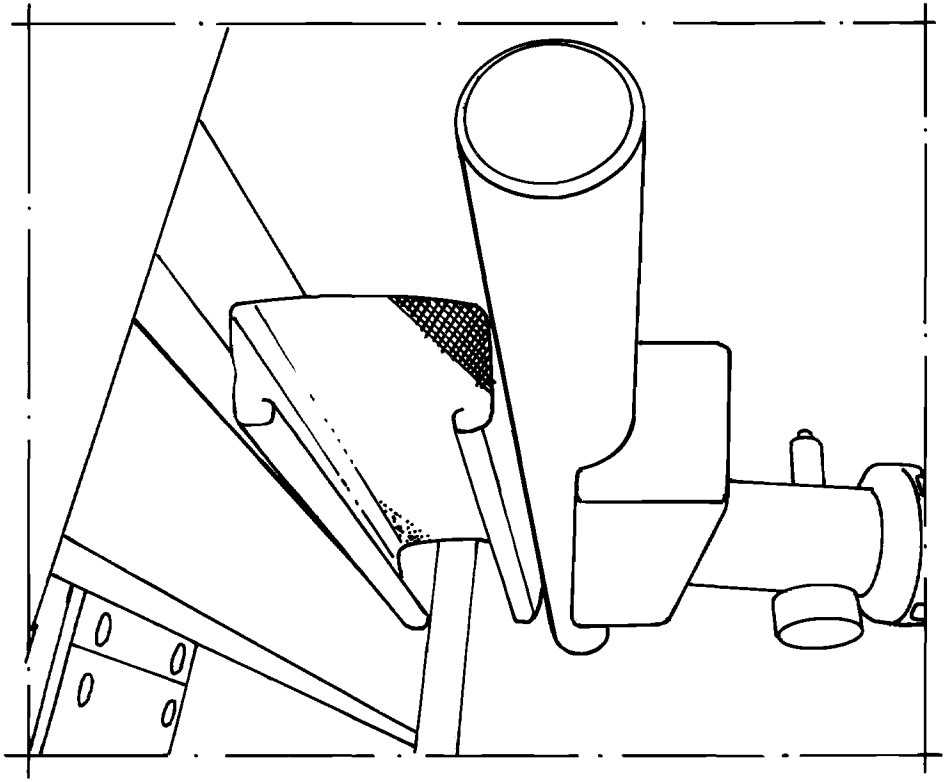
FIG. 10 shows a test rig for conducting the test of Example 5.

We decided to further investigate single leg compression performance by mounting a series of profiles of the invention in a test rig as shown in FIG. 10. The profiles of the invention were made in accordance with those of Example 1 and FIG. 1.

COMPARATIVE EXAMPLE 5

We tested a series of prior art profile having the same dimensions as those of Example 5 but absent the projections.

The results (average of four runs in each case) are shown in Table 5.

TABLE 5

Single Leg Test data for Example 5 and Comparative Example 5

| | Maximum load (N) | Maximum Extension (mm) | Force @ 4 mm (N) | Force @ 8 mm (N) |
|---|---|---|---|---|
| Ex. 5 | 303 | 13 | 156 | 254 |
| C. Ex. 5 | 188 | 14 | 91 | 153 |

These results demonstrate that as the amount of compression increases (that is as against Example 1), the profile of the invention shows better performance over the prior art.

EXAMPLE 6

To investigate the performance of the profile of the invention a series of stud walls were constructed, the walls being either 3.6 m high (Example 6A) or 4.2 m high (Example 6B). Each wall comprised a header and footer track section of 3.6 m length and between which 7 equispaced studs formed from profiles according to the invention were located.

For Example 6A a single layer of plasterboard was attached to each side of the so-formed frame to form a stud wall 3.6 m high and 3.6 m wide.

For Example 6B a double layer of plasterboard was attached to each side of the so-formed frame to form a stud wall 4.2 m high and 3.6 m wide.

Each wall was subjected to a positive pressure applied uniformly over the surface of the wall, the pressure being increased at 50 N/m$^2$ increments.

COMPARATIVE EXAMPLE 6

Two identical walls were constructed from prior art profiles which had the same characteristics but were absent the embossed projections of the invention.

Figure 11A:
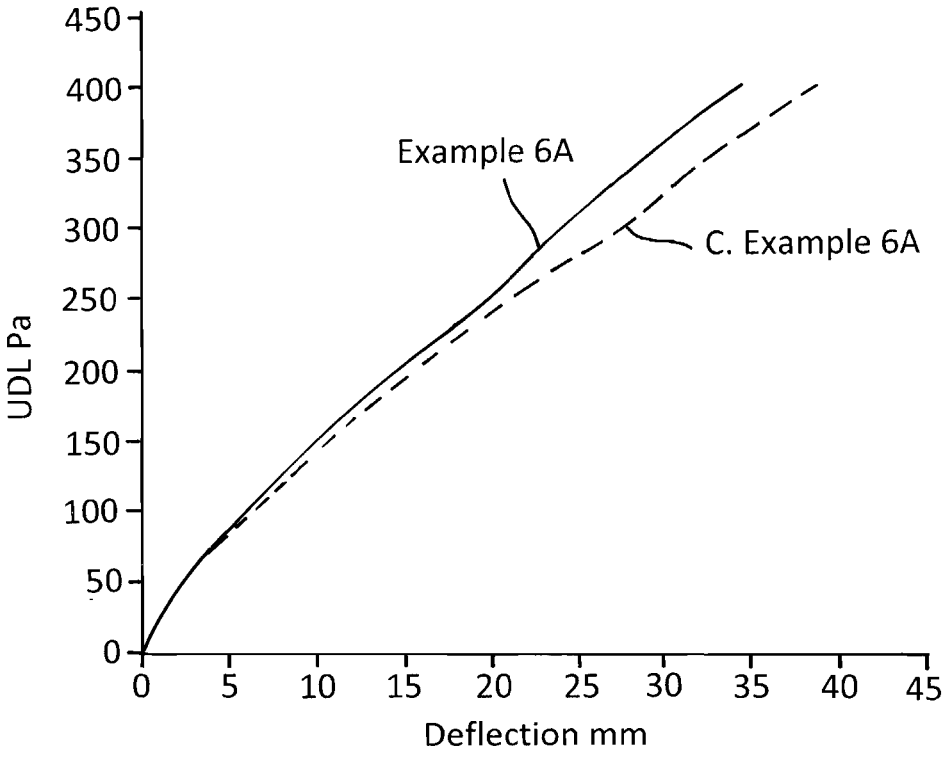
FIGS. 11A and 11B show graphs of experimental data of Example 6 and Comparative Example 6A.
Figure 11B:
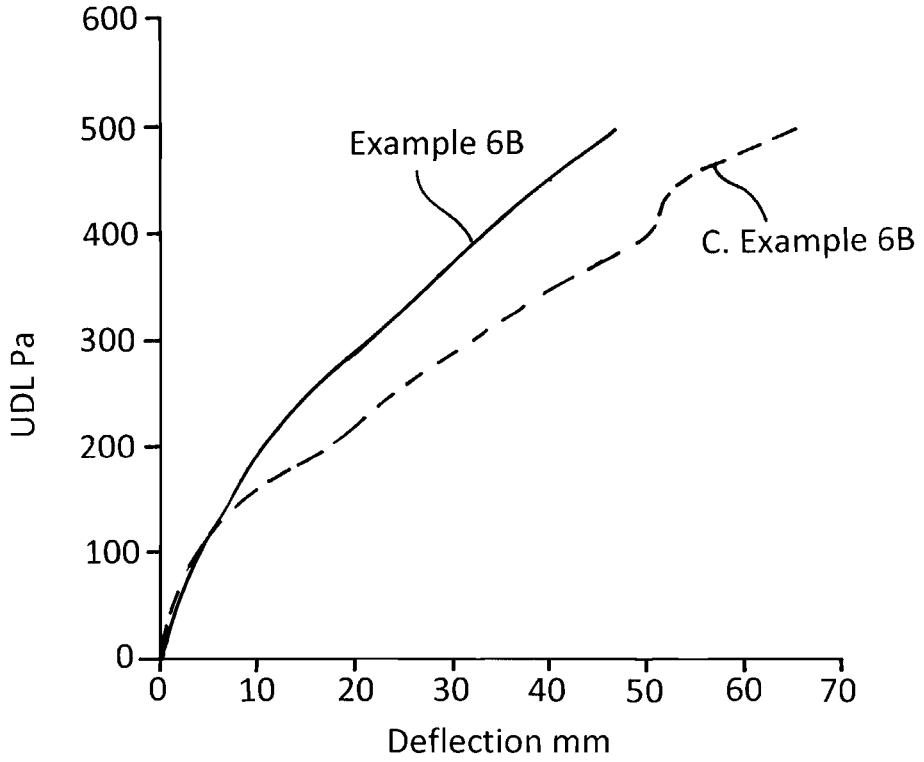

The results are shown in Table 6 and indicated graphically in FIG. 11A (3.6 m high walls) and FIG. 11B (4.2 m high walls).

TABLE 6

Wall performance data for Example 6 and Comparative Example 6

| | Def @ 200N/mm$^2$ (mm) | Force @ L/240 (N/m$^2$) | Bending Stiffness @ L/240 (Nm$^2$) |
|---|---|---|---|
| Ex. 6A | 14 | 205 | 29944 |
| C. Ex. 6A | 16 | 195 | 28515 |
| Ex. 6B | 11 | 266 | 62311 |
| C. Ex 6B | 17 | 202 | 46918 |

The data demonstrates that the profile of the invention performs better when constructed as a wall than profiles of the prior art.

Moreover, in a further test it was found that board stepping was significantly reduced in profiles of the invention as compared to profiles of the prior art.

It is also within the scope of the invention to provide an array of projections 10 at each vertex of non-co-linear portions of the profile 1, or any other profile. Moreover, projections 10 may be provided at a single vertex of non-co-linear portions of a profile (or the profile 1) or indeed at plural vertices.

The projections 10 on the profile 1 extend outwardly, which is preferred because, we believe, it leads to improved performance. Some or all of the projections in the same or different arrays (10*a-d*) may extend inwardly. Moreover, the embossing may be carried out by use of a forming roll (e.g. roll 180 or 190) which carries formations and a plain roll (e.g. the other of roll 190 or 180) the combined action of both causing formation of the projections 10*a-d*. The projections may be any shape. We prefer embossed projections with a shape having a principal axis which is not parallel to the principal axis of the profile because this leads to a greater improvement in performance.

We prefer profiles which have been both embossed, that is embossed to form said projections 10, and work-hardened. Tools which can perform both operations simultaneously on a sheet material are preferred. In preferred operations and tools, the embossing and embossing regions (and consequential embossments) are bound, in the transverse direction of the work-piece or sheet metal, by work hardening and work hardening regions (and consequential work hardened regions), in the running direction of the tool, the sheet material having corresponding embossments and work hardened zones.

The embossed projections may have a pitch of 3 mm or greater. In some embodiments, in a direction along an array of projections, from 30-70% of the distance is taken up by the width W of the projections. The pitch of the projections in an array on one joining portion may be different to the pitch of projections on another joining portion on the same profile.

The profile 1 may be in other shapes. It may provide grid for a suspended ceiling or other framing or sectional members. For example, the profile can be an I, Z, W or other sectional shape, for example a box section or other three dimensional shape, whether regular, irregular or otherwise convoluted. We can provide profiles from steel up to 3 mm thick.

The invention claimed is:

1. An elongate profile having a first portion and a second portion, the first and second portions being joined together at a first joining portion, the first and second portions being non collinear or non coplanar, the joining portion comprising an array of raised or rebated elongate formations, each raised or rebated elongate formation extending across the joining portion in a direction which is non-parallel to the principal axis of the profile and flat lands being provided between successive raised or rebated elongate formations in said array, where the flat lands are free of formations, and the pitch P between successive raised or rebated elongate formations in said array being from 2 to 20 times the thickness G of the flat land, and wherein in a direction along the array from 30-70% of the distance is taken up by the width W of the raised or rebated elongate formations.

2. A profile according to claim 1, further comprising a third portion and wherein the third portion is joined to the first portion at a second joining portion and wherein the second joining portion comprises an array of embossed formations.

3. A profile according to claim 2, wherein the first and third portions are non collinear or non coplanar.

4. A profile according to claim 2, wherein the first, second and third portions, and the first and second joining portions form a channel section.

5. A profile according to claim 1, wherein one or more of the raised or rebated elongate formations in said array has a principal axis which is inclined to the principal axis of the profile.

6. A profile according to claim 1, wherein one or more of the raised or rebated elongate formations in said array is rectangular.

7. A profile according to claim 1, wherein the first portion comprises, in sectional view, castellations.

8. A profile according to claim 1, wherein at least one of the first and second portions having an array of projections and depressions, the depressions on one side of said at least one of the first and second portions corresponding to projections on the other side of said at least one of the first and second portions.

9. A profile according to claim 1, wherein at least a part of the first or second portion is embossed, knurled or work hardened.

10. A profile according to claim 1, wherein at least one of the raised or rebated elongate formations in said array has a form depth F of between 0.5 and 4 times the base gauge G of the material.

11. A profile according to claim 1, wherein the pitch P of the raised or rebated elongate formations in said array is from 5 to 15 times the base gauge G of the material.

12. A profile according to claim 1, wherein each raised or rebated elongate formation in said array has a width W and the width W of a raised or rebated elongate formation is from 0.2P to P, wherein P is pitch P of the raised or rebated elongate formations in said array.

* * * * *